United States Patent [19]

Yaffe

[11] 4,248,721

[45] Feb. 3, 1981

[54] SYNTHETIC AIRCRAFT TURBINE OIL

[75] Inventor: Roberta Yaffe, Beacon, N.Y.

[73] Assignee: Texaco Inc., White Plains, N.Y.

[21] Appl. No.: 954,255

[22] Filed: Oct. 24, 1978

Related U.S. Application Data

[63] Continuation-in-part of Ser. No. 810,713, Jun. 28, 1977, abandoned.

[51] Int. Cl.[3] ..... C10M 1/48

[52] U.S. Cl. ..... 252/46.7; 252/565

[58] Field of Search ..... 252/46.7, 47, 565

[56] References Cited

U.S. PATENT DOCUMENTS 3,476,685 11/1969 Oberender et al. ..... 252/46.7

3,850,824 11/1974 Nebzydoski et al. ..... 252/46.7

3,865,739 2/1975 Waldbillig ..... 252/47

*Primary Examiner*—Andrew Metz

*Attorney, Agent, or Firm*—Carl G. Ries; Robert A. Kulason; James F. Young

[57] ABSTRACT

Synthetic lubricating oil composition having improved oxidation stability comprising a major portion of an aliphatic ester base oil having lubricating properties formed by the reaction of pentaerythritol and an organic monocarboxylic acid and containing an alkylphenyl or alkarylphenyl naphthylamine, a dialkyldiphenylamine, a polyhydroxyanthraquinone, a hydrocarbyl phosphate ester and a thiadiazole derivative mixture as hereinafter defined.

10 Claims, No Drawings

SYNTHETIC AIRCRAFT TURBINE OIL

This application is a continuation-in-part application of application Ser. No. 810,713, filed June 28, 1977, now abandoned.

BACKGROUND OF THE INVENTION

1. Field of the Invention

This invention is concerned with a pentaerythritol ester base lubricating oil composition for a gas turbine engine. Gas turbine engines are operated under a wide range of temperature conditions. The lubricant must be fluid at extremely low temperatures and at the same time retain its lubricating properties in an engine which produces internal operating temperatures at 450°-550° F. or above. The lubricant is subjected to severe oxidation stresses under the high running temperatures encountered in such engines.

Ester base lubricating oil compositions prepared from pentaerythritol and a mixture of fatty acids and containing selected additive combinations are well known. These lubricants are functional over a wide temperature range and exhibit good thermal and oxidative stability. The search for a still more effective, longlived ester base lubricant composition, however, is a major goal of lubricant manufacturers. In addition, more advanced gas turbine engines currently being developed and tested will put higher stresses on the lubricant composition and are projected to require improved lubricant compositions.

2. DESCRIPTION OF THE PRIOR ART

U.S. Pat. No. 3,865,739 discloses and claims a novel thiadiazole derivative mixture as being effective in inhibiting the corrosion of cooper by hydrocarbon oil formulations of lubricating viscosity.

SUMMARY OF THE INVENTION

The synthetic lubricating oil composition of the invention comprises a major portion of an aliphatic ester base oil having lubricating properties, an alkylphenyl or alkarylphenyl naphthylamine, a dialkyldiphenylamine, a polyhydroxyanthraquinone, a hydrocarbyl phosphate and a thiadiazole derivative mixture as hereinafter defined. More specifically, the lubricating oil composition of the invention comprises a major portion of an aliphatic ester base oil formed from the reaction of pentaerythritol and an organic monocarboxylic acid having from about 2 to 18 carbon atoms per molecule and (a) from about 0.3 to 5 percent by weight of the lubricating oil composition of alkyl or alkaryl derivatives of phenyl naphthylamines in which the alkyl radicals contain from 4 to 12 carbon atoms, (b) from about 0.3 to 5 percent by weight of a dialkyldiphenylamine in which the alkyl radicals contain from 4 to 12 carbon atoms, (c) from about 0.01 to 0.5 percent by weight of a polyhydroxyanthraquinone, (d) from about 0.25 to 10 percent by weight of a hydrocarbyl phosphate ester in which said hydrocarbyl radical contains an aryl ring and has from about 6 to 18 carbon atoms, and (e) from about 0.005 to 0.05 percent by weight of a thiadiazole derivative mixture as hereinafter defined.

The lubricating oil composition of the invention provides substantial improvements in control of acidity and viscosity increases under severe oxidizing conditions.

DETAILED DESCRIPTION

The base fluid component of the composition of the invention is an ester-base fluid prepared from pentaerythritol and a mixture of hydrocarbyl monocarboxylic acids. Polypentaerythritols, such as dipentaerythritol, tripentaerythritol and tetrapentaerythritol can also be employed in the reaction to prepare the base oil.

The hydrocarbon monocarboxylic acids which are used to form the ester-base fluid include the straight-chain and branched-chain aliphatic acids, as well as mixtures of these acids. The acids employed have from about 2 to 18 carbon atoms per molecule, and preferably from about 2 to 18 carbon atoms per molecule, and preferably from about 5 to 10 carbon atoms. Examples of suitable acids are acetic, propionic, butyric, valeric, isovaleric, caproic, decanoic, tertiarybutylacetic and 2-ethylhexanoic acid, including mixtures.

In general, the acids are reacted in proportions leading to a completely esterified pentaerythritol or polypentaerythritol with the preferred ester bases being the pentraerythritol tetraesters. Examples of such commerically available tetraesters include pentaerythritol tetracaproate, which is prepared from purified pentaerythritol and crude caproic acid containing other C5-10 monobasic acids. Another suitable tetraester is prepared from a technical grade pentaerythritol and mixture of acids comprising 38 percent valeric, 13 percent 2-methyl pentanoic, 32 percent octanoic and 17 percent pelargonic acids, by weight.

The ester base comprises the major portion of the fully formulated synthetic ester base lubricating oil composition. In general, this ester base fluid is present in concentrations from about 90 to 98 percent of the composition, by weight.

The essential alkyl or alkaryl phenyl naphthylamine component of the invention is represented by the formula:

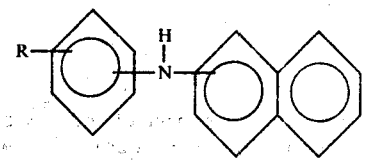

in which R is an alkyl or alkaryl radical containing from about 4 to 12 carbon atoms. This radical can be a straight or branched chain alkyl radical with the tertiary alkyl structure being preferred or it can be an alkaryl radical. The naphthylamine can be either an alpha or beta naphthylamine. Specific effective compounds of this class include N-(4-cumylphenyl)-alpha or beta-naphthylamine, N-(paratertiary-octylphenyl) alpha or beta-naphthylamine, and the corresponding para-tertiary-dodecylphenyl and para-tertiarybutylphenyl alpha or beta-naphthylamines. The preferred naphthylamines are those in which R is a tertiary alkyl radical having from 6 to 10 carbon atoms therein. The preferred concentration of this component is from about 0.5 to 2.5 percent, by weight.

Another essential component of the lubricating oil composition of the invention is a dialkyldiphenylamine. These compounds are represented by the formula:

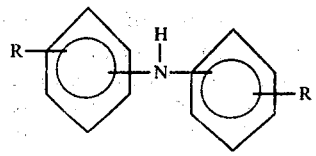

in which R is an alkyl radical having from about 4 to 12 carbon atoms. Suitable alkylamines include dioctyldiphenylamine, didecyldiphenylamine, didodecyldiphenylamine, dihexyldiphenylamine and similar compounds. Dioctyldiphenylamine is the preferred compound and the preferred concentration is from 0.5 to 2.0 percent, by weight.

The essential metal deactivator of the lubricating oil composition of the invention is a polyhydroxy substituted anthraquinone. Suitable compounds in this class are the dihydroxyanthraquinones, such as 1,4-dihydroxyanthraquinone and 1,5-dihydroxyanthraquinone and the higher polyhydroxy substituted anthraquinones such as 1,2,4-trihydroxyanthraquinone and 1,2,5,8-tetrahydroxyanthraquinone. The preferred concentration of this component is from about 0.01 to 0.5 weight percent.

Another component of the lubricating oil composition of the invention is a hydrocarbyl phosphate ester, more specifically a trihydrocarbyl phosphate in which the hydrocarbyl radical is an aryl or alkaryl radical or mixture thereof containing from 6 to 18 carbon atoms and preferably from 6 to 12 carbon atoms. Effective specific compounds include tricresylphosphate, cresyl diphenylphosphate and triphenylphosphate. These compounds are preferably present in the lubricating oil composition in a concentration ranging from about 0.5 to 5 percent, by weight.

Another essential component of the lubricating oil composition is the thiadiazole derivative mixture as hereinafter defined.

This component is present in the lubricating oil composition in an amount of from about 0.005 to about 0.05 wt. %, preferably at a concentration of 0.05 wt. %.

The expression "thiadiazole derivative mixture" as hereinafter defined is intended to refer to the thiadiazole derivative mixture containing as a principal component an alkylidenimino thiadiazole characterized by the formula

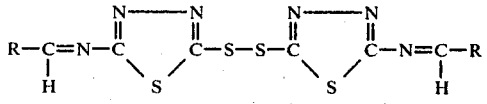

wherein R is an alkyl radical containing from 2 to 30 carbons; this material being prepared by first contacting 2-amino-5-mercapto-1,3,4-thiadiazole with an alkanal of the formula RCHO and secondly contacting the resultant reaction mixture with dimethylsulfoxide.

The thiadiazole derivative mixture is more fully described in U.S. Pat. No. 3,865,739, the disclosure and claims thereof being incorporated herein by reference.

EXAMPLE I

This example illustrates the preparation of the 2-mercapto-5-amino-1,3,4-thiadiazole precursor.

To a solution of 18.2 grams (0.2 mole) of thiosemicarbazide in 400 mls. of dimethylformamide there was charged 16.8 grams (0.22 mole) of carbon disulfide. The resultant mixture was heated to and maintained at 80° C. for a period of 4 hours. The reactant mixture was then stripped on a rotary evaporator leaving a solid residue. The product was stirred ½ hr. with 1000 mls benzene and restripped. The solid was dissolved in 1000 mls. of anhydrous ethanol and 17.0 grams of the product crystallized from the ethanol. It was analyzed and identified as 2-mercapto-5-amino-1,3,4-thiadiazole of the following analysis: Cal. 31.6, (found 31.85) wt. % nitrogen, Calc. 48.1, (found 47.4) wt. % sulfur.

EXAMPLE I

This example illustrates the preparation of the thiadiazole derivative product mixture of the invention.

A mixture of 7.8 grams (0.05 mole) decylaldehyde 7.0 grams (0.05 mole) 2-mercapto-5-amino-1,3,4-thiadiazole of the type prepared in Example I and 200 mls. of benzene were heated to reflux (80° C.) to remove as overhead 0.3 ml. of insoluble phase. To the residual refluxed mixture 3.0 mls. of dimethylsulfoxide were added and the formed mixture was again heated at reflux to remove 0.2 ml. water as overhead. The product was then stripped to 93° C. under reduced pressure (2 mm Hg). The residue was identified as a derivative mixture containing as a principal product the decylaldehyde reaction product of 2-mercapto-5-amino-1,3,4-thiadiazole characterized by the formula:

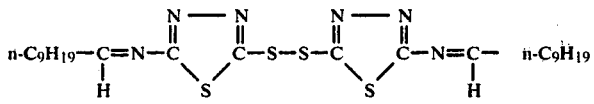

Elemental mixture analysis gave Calc. 14.1 (found 14.2) wt. % nitrogen and 22.1 (found 21.7) wt. % sulfur.

The novel lubricating oil compositions of the present invention exhibit improved oxidation stability, particularly excellent control of acidity and viscosity increase under severe oxidizing conditions.

The ester base oil employed in preparing the lubricating oil composition of the invention comprised pentaerythritol containing a minor amount of dipentaerythritol esterified with a mixture of fatty acids. It consisted of technical grade pentaerythritol ester made from a mixture of carboxylic acid consisting of (mole %):

| | |
|---|---|
| i - C5 | 8 ± 3% |
| n - C5 | 23 ± 5% |
| n - C6 | 20 ± 5% |
| n - C7 | 27 ± 5% |
| n - C8 | 7 ± 3% |
| n - C9 | 16 3% |

This ester base oil had the following properties:

| | |
|---|---|
| Viscosity, cs at 210° F. | (5.01) |

-continued

| | |
|---|---|
| Viscosity, cs at 100° F. | (25.6) |
| Viscosity, cs at −40° F. | (7005) |
| Viscosity Index | (140) |
| Flash, °F. | (515) |

The above base oil was blended with all of the prescribed essential additives with the exception of the thiadiazole derivative mixture to form a Base Fluid. Based on a fully formulated lubricant composition, the Base Fluid consisted of about 95.4 weight percent of the ester base oil described above with 1.5 weight percent of t-octyl-phenyl-alpha-naphthylamine, 1.0 weight percent of dioctyldiphenylamine, 2.0 weight percent of tricresylphosphate and 0.1 weight percent of quinizarin.

The oxidative-stability of the lubricant of the invention as compared to the Base Fluid was determined in the Rolls Royce (RR 1001) Oxidation Test. (D. Eng. R D2497 Supplement Method No. 12). The results are set forth in the following Table.

TABLE

ROLLS ROYCE (RR 1001) OXIDATION TEST 260° C./6 HRS

| | BASE FLUID | BASE FLUID + 0.05 WT. % ADDITIVE "A" |
|---|---|---|
| % Viscosity Change at 100° F. | 96.1 | 42.1 |
| Total Acid Number Change | 4.01 | 3.59 |

Additive A - The thiadiazole derivative mixture.

The data in the Table above show that the oxidative stability of the lubricating oil compositions of the present invention are significantly improved in comparison to the Base Fluid.

In comparison to the Base Fluid the composition showed a reduction in Viscosity Increase of about 56% at 0.05% concentration. Similar good results were found with respect to the reduction in Total Acid Number Increase over the Base Fluid, 10% at 0.05% concentration.

In further testing the lubricant composition of this invention containing the thiadiazole derivative additive at 0.05 wt. % was found to completely satisfy the requirements of the Navy MIL-L-23699B Specification in the Oxidation-Corrosion test at 400° F./72 HRS. and the Ryder Gear Test, and to fully satisfy the requirements of the Pratt and Whitney Aircraft Specification PWA 521B in both Oxidation-Corrosion (425° F./48 HRS.) and SOD Lead Corrosion (375° F./5 HRS.) Testing.

At a concentration of 0.1% by weight of the thiadiazole mixture, the composition failed the Pratt and Whitney Aircraft Specification PWA 521B Oxidation-Corrosion Test with respect to Copper Corrosion. The amount of corrosion was 0.97 mg/cm2, which is far in excess of the test limits of ±0.30 mg/cm2 for Copper.

Obviously, many modifications and variations of the invention has hereinbefore set forth may be made without departing from the spirit and scope thereof and therefore only such limitations should be imposed as are indicated in the appended claims.

I claim:

1. A synthetic lubricating oil composition consisting of a major portion of an aliphatic ester base oil having lubricating properties formed from the reaction of pentaerythritol and an organic monocarboxylic acid having from about 2 to 18 carbon atoms per molecule and (a) from about 0.3 to 5 percent by weight of the lubricating oil composition of an alkyl or alkaryl phenyl naphthylamine in which the alkyl radical has from 4 to 12 carbon atoms, (b) from about 0.3 to 5 percent by weight of a dialkyldiphenylamine in which the alkyl radicals have from 4 to 12 carbon atoms, (c) from about 0.01 to 0.05 percent by weight of a polyhydroxy substituted anthraquinone, (d) from about 0.25 to 10 percent by weight of a hydrocarbyl phosphate ester in which said hydrocarbyl radical contains an aryl ring and contains from about 6 to 18 carbon atoms, and (e) from about 0.005 to 0.05 percent by weight of a thiadiazole derivative mixture containing as a principal product an alkylidenimino thiadiazole characterized by the formula:

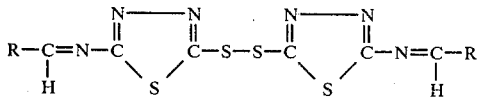

where R is alkyl of rom 2 to 30 carbons, said thiadiazole derivative mixture being prepared by the process comprising first contacting 2-amino-5-mercapto-1,3,4-thiadiazole with an alkanal of the formula RCHO where R is alkyl of from 2 to 30 carbons at a temperature of between about 20° and 250° C. utilizing a mole ratio of 2-amino-5-mercapto-1,3,4-thiadiazole to alkanal of between about 10:1 and 1:2 to form an intermediate thiadiazole product characterized by the formula:

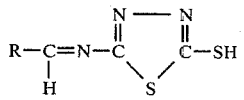

and second contacting said intermediate thiadiazole product with dimethyl sulfoxide at a temperature of between about 20° and 150° C. utilizing a mole ratio of said intermediate to said dimethyl sulfoxide of between about 3:1 and 1:50 to form said thiadiazole derivative mixture.

2. A lubricating oil composition as claimed in claim 1 wherein said derivative mixture is present in an amont of about 0.05% by weight.

3. A lubricating oil composition as claimed in claim 1 wherein R is dodecyl.

4. A lubricating oil composition as claimed in claim 1 wherein R is decyl.

5. A lubricating oil composition as claimed in claim 1 wherein the naphthylamine is octylphenyl-alpha-or-beta-naphthylamine.

6. A lubricating oil composition as claimed in claim 5, wherein the dialkyldiphenylamine is a dioctyldiphenylamine.

7. A lubricating oil composition as claimed in claim 1 containing from about 0.01 to 0.5 percent by weight of said polyhydroxy-substituted anthraquinone.

8. A lubricating oil composition as claimed in claim 7 wherein the polyhydroxy-substituted anthraquinone is a dihydroxyanthraquinone.

9. A lubricating oil composition as claimed in claim 1 containing from about 0.5 to 5 percent by weight of a hydrocarbyl phosphate ester.

10. A lubricating oil composition as claimed in claim 1 wherein the aliphatic ester base oil is present in a concentration of from about 90 to 98 percent by weight of the composition.

* * * * *